United States Patent [19]

Larson

[11] 3,976,482

[45] Aug. 24, 1976

[54] METHOD OF MAKING PREALLOYED THERMOPLASTIC POWDER AND CONSOLIDATED ARTICLE

[75] Inventor: Jay Michael Larson, Warwick, N.Y.

[73] Assignee: The International Nickel Company, Inc., New York, N.Y.

[22] Filed: Jan. 31, 1975

[21] Appl. No.: 546,001

[52] U.S. Cl. ..... 75/211; 75/.5 R; 75/214; 148/126

[51] Int. Cl.[2] ..... B22F 1/00

[58] Field of Search ..... 75/171, 211, .5 R, .5 BA, 75/.5 GB, .5 BC, .5 AA, .5 AB, .5 AC; 264/111; 29/420, 420.5; 148/126

[56] References Cited

UNITED STATES PATENTS 3,099,080 7/1963 Worn ..... 29/420

3,865,575 2/1975 Volin ..... 75/.5 R

OTHER PUBLICATIONS

"New Developments in Superalloy Powders, " Reichman et al. Modern Development in Powder Metallurgy, vol. 5, pp. 73–84.

*Primary Examiner*—Edward A. Miller

*Attorney, Agent, or Firm*—Raymond J. Kenny; Ewan C. MacQueen

[57] ABSTRACT

The invention is directed to a process for improving workability of prealloyed powders, particularly those of the superalloy type, in which powder is cold reduced by subjecting it to the compressive forces exerted by the rolls of a rolling mill, as a consequence of which strain energy is imparted to the powder.

25 Claims, 3 Drawing Figures

EFFECT OF TEMPERATURE ON HARDNESS ($R_A$) OF CONSOLIDATED THERMOPLASTIC PREALLOYED IN-100 POWDER VS. CONSOLIDATED AS-PREALLOYED IN POWDER

METHOD OF MAKING PREALLOYED THERMOPLASTIC POWDER AND CONSOLIDATED ARTICLE

The present invention is directed in general to powder metallurgy (P/M), and is particularly addressed to the production of highly alloyed superalloy powders, powders which in terms of composition per se are at best difficulty hot workable using conventional processing, whether by the melting-casting-working route or in accordance with known P/M techniques.

As is generally known, over the years the metallurgical art has been under a continuous burden to develop new alloys capable of responding to the ever increasing operating demands imposed by any number of diverse applications, the aircraft industry having played a prominent role in this regard. For example, great strides have been made in gas turbine engine alloy development in coping with aircraft designed to perform under greater load-bearing capacities and at higher speeds, etc., factors which, in turn, give rise to higher operating temperatures and stresses.

In past years, superalloys in the cast and wrought forms have largely met the requirements imposed. As to cast alloys, as the operating requirements have become more stringent the difficulties associated with macro- and micro-segregation severely limited this approach. Too, product shape is inherently self-limited by reason of normal casting capabilities. And in certain cases casting technology cannot be applied at all, irrespective of other factors.

In terms of the wrought superalloys, as the need for stronger and harder alloys was of a necessity, the most advanced and potentially desirable alloys manifested the unfortunate propensity of being virtually impossible to hot-work and fabricate. Table I below lists four such nickel-base alloys (nominal composition).

TABLE I

| Alloy | Cr | Co | Mo | Ti | Al | B | Zr | C | W | Cb |
|---|---|---|---|---|---|---|---|---|---|---|
| IN-100 | 10 | 15 | 3 | 4.7 | 5.5 | .014 | .06 | .18 | — | — |
| Astroloy | 15 | 15 | 5.25 | 3.5 | 4.4 | .03 | — | .06 | — | — |
| Rene 95 | 14 | 8 | 3.5 | 2.5 | 3.5 | .01 | .05 | .15 | 3.5 | 3.5 |
| IN-792* | 13 | 9 | 2.0 | 4.4 | 3.2 | .02 | .07 | .05 | 3.9 | — |

*3.9 Ta

Common to such materials is a substantial percentage of the gamma prime hardeners titanium, aluminum, columbium and tantalum, and a significant quantity of one or more of the matrix strengtheners, molybdenum and tungsten. To reduce the percentages of such constituents means a loss in properties. Maintaining such percentages invites the difficulties attendant hot working and fabricating.

Given the inadequacies of the wrought and cast superalloy technologies, the art turned to powder metallurgy. One of the earlier P/M successes involved a technique termed "gatorizing," but insofar as I am aware, this approach suffers from the drawback, again inherent, of being limited by the section size of the products that can be produced with available equipment.

Recently, a new concept was discovered, a concept (disclosed in U.S. patent application Ser. No. 316,077, U.S. Pat. No. 3,865,575) involving the imparting of strain energy into prealloyed superalloy powder, the result of which is that the powder becomes thermoplastic. To my knowledge, prealloyed super-alloy powder of the type under consideration had never been subjected to compressive forces of such magnitude as to change the powder character such that it exhibited "thermoplasticity," this all occurring before consolidation procedures.

The present invention encompasses the "strain energy" concept, but I have discovered a refined technique of achieving a continuous type process, a process which lends to minimizing contaminant pick-up that can arise with other cold working processes that might be used to induce the strain energy.

Furthermore, I have discovered, most surprisingly, that consolidated prealloyed powders produced in accordance with the invention have a highly desirable coarse grain structure, less than ASTM 5, upon solution treatment. Higher mechanical properties at elevated temperature can be expected. Turbine blade production as well as disc production should be facilitated. Moreover, the subject invention is economical and its simplicity is decidedly attractive from the commercial viewpoint.

Figure 1:
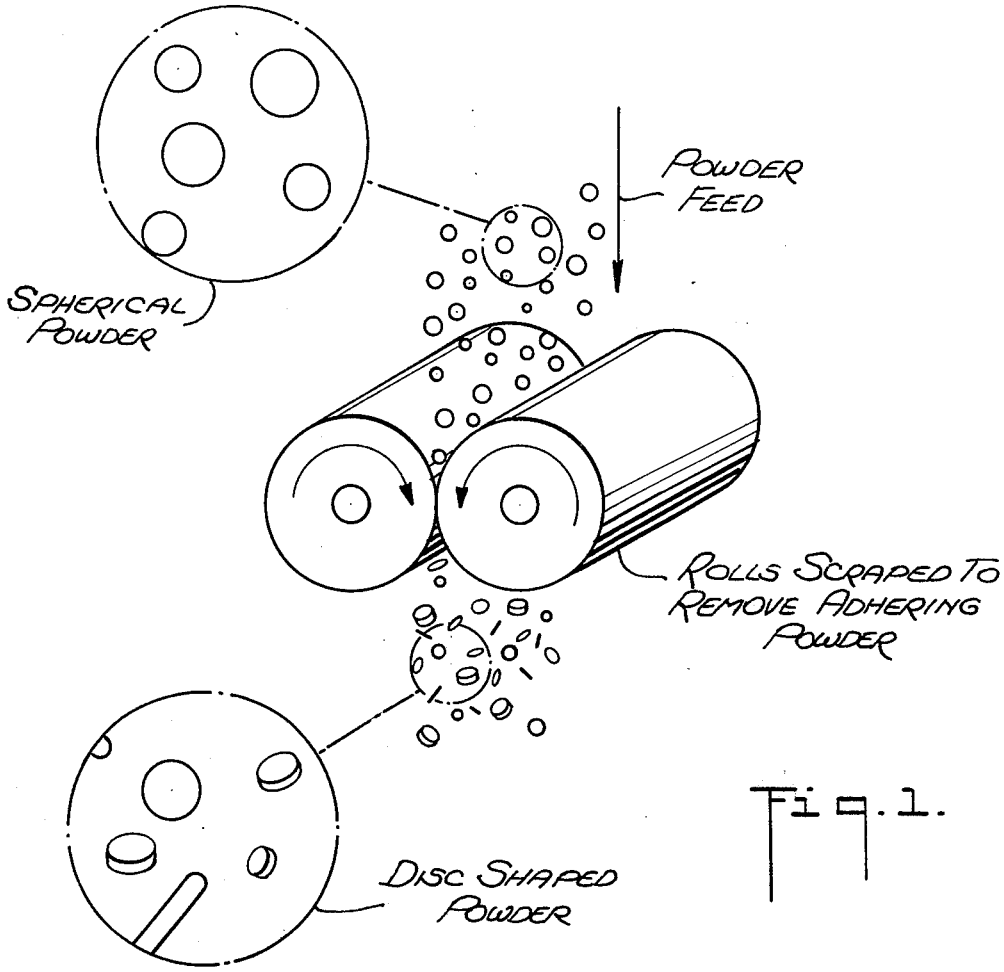
FIG. 1 is a diagrammatical illustration of a rolling mill in the process of flattening spherical powder.

Generally speaking, the present invention contemplates subjecting prealloyed, highly alloyed superalloy powders of the nickel- and/or cobalt- and/or iron-base types, alloys normally difficult to hot work and fabricate using conventional technologies, to the compressive forces generated by properly spaced rolls of a rolling mill, whereby the powder particles take on the "thermoplastic" condition as further described herein. Heating the so-processed powder to consolidation temperature and compacting results in considerable grain refinement in comparison with the unprocessed prealloyed powder, the thermoplastic powder manifesting a markedly lower flow stress. Subsequent forming operations can be conducted at lower temperatures and/or stresses than otherwise would be the case with conventional means, including P/M processing. Because of this state of thermoplasticity, tremendous flexibility in operation is afforded. On the one hand, it is considered that large diameter discs, say 4 or 5 feet in diameter, can be hot isostatically pressed for aircraft or industrial gas turbine use, while on the other hand intricate, complex shapes can be formed as by, for example, extrusion.

In carrying the invention into practice, certain parameters should be observed as described below.

Powder Feeding

Prealloyed powder should preferably be fed to the working rolls in substantially monolayer form in order that the impingement of the powder particles one upon another is minimized during the time interval the compressive forces of the rolls act upon the particles. This serves to substantially reduce, if not completely eliminate, cold bonding or cold welding from occuring, thus contributing to relatively uniform powder thickness. A vibratory device capable of dispensing the powder over an edge such that it cascades through a series or plurality of fins and eventually dropping on the roll surfaces is deemed satisfactory.

Rolls and Operation

The diameter of the rolls must be sufficiently large to pull the powder into the roll gap in order for the desired powder deformation to take place. To date rolls as small as 2¼ inches in diameter have been successfully used, the roll surface being carbide. 9-inch diameter rolls of AISI 52100 steel have also been satisfactorily used.

Most advantageously the rolls are of a carbide surface. Rolls of this type exhibit good wear resistance, thus minimizing contamination, and retain a high polish, say, less than 100 microinches and most preferably below 50 microinches, which contributes to uniform processing and also minimizes objectionale pocking. Moreover, carbide rolls have a high elastic modulus which is largely responsible for avoiding roll indentation by the powder. This in turn contributes to uniformity of powder thickness.

The rolls should be designed such that the gap or opening therebetween is approximately 0.002 inch during rolling (dynamic roll gap). As a practical matter, superalloy prealloyed powder particles to be processed will generally be of a mesh size of 20 or finer. In accordance with the invention, a roll gap of about 0.002 inch assures that, for example, a +325 mesh size of difficulty workable powder such as IN-100 will have been sufficiently refined to achieve virtually full density during compaction (consolidation) at a temperature circa 1900°F. A −230 mesh IN-100 prealloyed powder, even in the atomized condition, has a fine enough grain size (approx. 10 $\mu$m) to be compacted to practically full density at the 1900°F. temperature without need of grain refinement. It is to be understood, of course, that dynamic roll gaps other than about 0.002 inch, e.g., 0.001 to about 0.015 inch, can be used. This will be dictated by powder size, composition, production, speed, etc.

Roll Speed

Roll speed must be such as to impart the desired strain energy, given the composition, particle size, etc. It can be quickly determined depending upon the parameters attendant the intended application of use. A speed of 35 revolutions per minute (rpm) has been satisfactorily used; however, roll speed undoubtedly can be much faster in an effort to increase productivity, say, 1000 or 1500 rpm or more. The maximum useable roll speed would likely be limited by the system used to cool the rolls.

Roll Passes

Prealloyed superalloy powder can be subjected to more than one roll pass. In accordance with the most advantageous embodiments of the invention, the rolled powders, normally formed from as-atomized spherical superalloy powders, should be characterized by a true aspect ratio of greater than about 1.25 to 1 and preferably at least 2 or 3 to 1. (True aspect ratio is represented as the average diameter of the rolled particles divided by average particle thickness.) By observing this requirement, an overall considerably smaller average grain size, e.g., smaller than ASTM 10, can be achieved.

By way of explanation, a −40 mesh IN-100 prealloyed powder was deposited upon carbide rolls and rolled to a disc-like shape. It was found the powder was sufficiently processed, i.e., thermoplastic, such that despite being −40 mesh powder initially full density could be achieved with only one pass through the rolling mill. Notwithstanding this, however, the material was of a wide grain size pattern in the ascompacted state, i.e., ASTM 16 up to as large as ASTM 5. This powder was compacted by ramming the material in a mild steel can against an extrusion press.

Since there are probably applications in which the as-consolidated powder should be of a more uniform fine grain size, a second or third pass through the rolling mill would be of benefit.

IN-792 powder was subjected to one or more passes, the processed powder then being hot isostatically pressed. A duplex microstructure was observed with large grains being substantially surrounded by fine grains. However, by screening the IN-792 powder and subjecting it to one or more passes through a rolling mill it was found that a relatively uniform grain size, ASTM 16-10, was obtained in respect of consolidated particles having a true aspect ratio of about 2 or more. Data concerning mesh size, number of rolling passes and true aspect ratio are given in Table II.

TABLE II

| Mesh Size | | No. of Passes | Avg. Aspect Ratio |
|---|---|---|---|
| −40 | +60 | 1 | 5.1 |
| −60 | +100 | 1 | 3.4 |
| −60 | +100 | 2 | 4.3 |
| −100 | +200 | 1 | 2.5 |
| −100 | +200 | 2 | 2.7 |
| −100 | +200 | 3 | 3.9 |
| −200 | +325 | 1 | 2.0 |
| −200 | +325 | 2 | 3.0 |
| −200 | +325 | 3 | 3.0 |
| −325 | | 1 | 1.2 |

Collection or Processed Powder

It is important that the prealloyed powder not be permitted to adhere to the roll surfaces such that it repeatedly passes between the same rolls; otherwise, powder build-up will occur ultimately forcing the rolls further apart accompanied by damage to the roll surfaces. A rotary brush system designed to remove adhering powder can be used. Preferably, the powder is then quickly collected through a vacuum system connected to a collecting hopper.

Nature of Powders Processed

In most instances, superalloy prealloyed powder rolled in air will undergo no serious adverse effects by reason of such an ambient atmosphere. However, if a highly reactive powder were thermoplastically processed, it might be advisable to employ an inert atmosphere.

Figure 2:
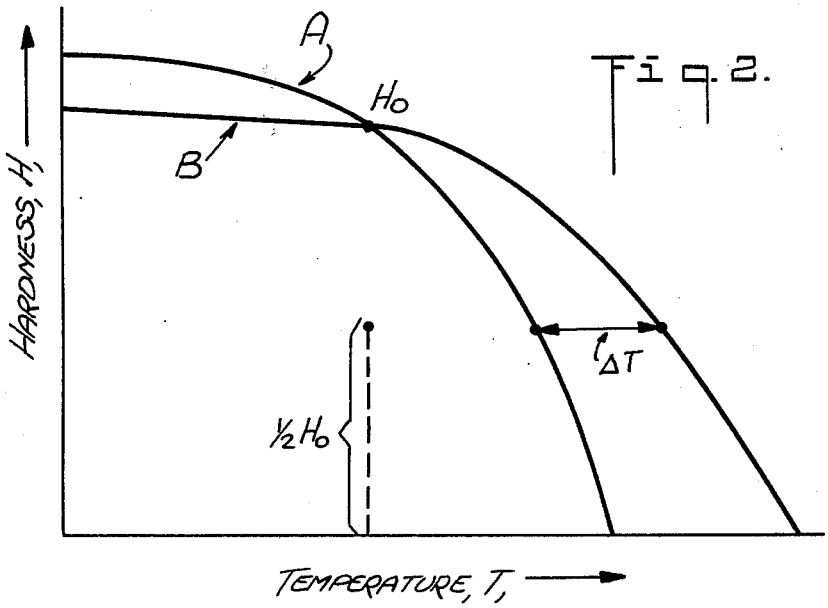
FIGS. 2 and 3 are hardness vs. temperature graphs showing the improvement attainable with treated powder compared with untreated powder.

In determining when prealloyed superalloy powder has been rolled such that the thermoplastic state has been achieved, the principles used in said U.S. application Ser. No. 316,077 can be employed, and in this connection reference is made to FIG. 2. Curve A of FIG. 2 represents prealloyed powder which has been subjected to strain energy, Curve B representing prealloyed powder of the same composition but which has not been so processed. Point $H_o$ represents a common hardness value for each of the prealloyed powders at a given temperature, the respective powders having been consolidated to a density of at least 99% of theoretical, i.e., $H_o$ occurs at the temperature at which the hardness of the thermoplastic powder is the same as that of the non-rolled prealloyed powder.

If an amount of strain energy has been imparted to prealloyed powder such that at the point ½ $H_o$, ΔT/TM (the temperature differential, ΔT, between the respective hardness curves divided by the absolute melting temperature of the alloy, TM) is at least 1%, the prealloyed powder is deemed thermoplastic. However, this thermoplastic condition, referred to as TPC-1 (Thermoplastic Physical Characteristic), is considered to be minimal. Preferably this ratio (ΔT/TM) should be at least 2% (TPC-2) and most advantageously at least about 5% (TPC-3). This contributes greatly to minimum flow stress and lower pressing temperatures which in turn reduce the otherwise required load on a press (or equivalent functioning equipment).

It is conceivable that some materials may not show an $H_o$ hardness value. This could be the case in respect of, for example, a material in which the increase in hardness due to the strain energy input is less than that of a hardening phase destroyed during the energy input. Too, it is considered that there are alloy materials in which an $H_o$ value exists at a lower temperature than the lower limit hardness test temperature. In such instances, the $H_o$ value would be replaced by the expression $(H_A/2)_{RT} + (H_B/2)_{RT}$, $(H_A)_{RT}$ being the room temperature hardness of the prealloyed powder and $(H_B)_{RT}$ being the room temperature hardness of the same powder in the processed condition. It is to be understood that the claims appended hereto are to be so construed with regard to Thermoplastic Physical Characteristic values. Thus, at ½ $[(H_A/2)_{RT} + (H_B/2)_{RT}]$, the ΔT/TM ratio must be at least 1% in order for the processed powder to be considered thermoplastic.

In order to provide those skilled in the art with a better understanding of the invention, the following illustrative examples are provided.

EXAMPLE I

To illustrate the difference between the consolidating of thermoplastic powder produced in accordance with the invention and consolidating as-prealloyed powder, IN-792 powder, virtually all of a mesh size −40 +325, was divided into two equal batches. One sample was placed within a disc-shaped container (container A) formed of a superplastic alloy nominally of about 66% Fe, 26% Cr, 6.5% Ni, 0.5% Mn, 0.5% Si, 0.2% Ti, 0.05% with low P and S. The other batch of powder was passed through carbide rolls, the rolls being about 2¼ inches in diameter and approximately 0.002 inch dynamic gap. One roll pass was used, the rolls being rotated at about 35 rpm. This thermoplastically processed powder was then placed in a similar disc-shaped container (container B).

The disc-shaped containers were then hot isostatically pressed (HIP) at 15,000 psi for 1 hour. Container A with the conventionally processed powder was HIPed at 2155°F. whereas Container B was pressed at 1960°F., nearly 200°F. below the former.

Upon evaluation it was found that the compact formed of powder processed in accordance herewith reached a density just about that of possible theoretical, porosity being well less than 0.07%. This was in marked contrast with the conventional product which exhibited a high degree of porosity, to wit, 1.8%, despite the 195°F. higher compacting temperature. A consolidation temperature of 2250°–2300°F. might have afforded a comparable density level as achieved through the subject invention, but it is deemed that the as-compacted grain size would have been on the order of that of the original powder particles.

Specimens of the respective compacts were also tested to determine flow stress characteristics. A temperature of 1900°F. was used and the compact within the invention displayed a low flow stress of 5,200 psi (0.01 $min^{-1}$ strain rate) vs. 8,900 psi (70%, higher) for the conventionally processed material. It might be mentioned had the container A powder been compacted at the 1950°F. temperature, it would not have even been consolidated enough to give a flow stress value.

Upon solution heating at 2225°F. for 1 hour, a highly desired coarse grain, ASTM 2–3, was obtained for the thermoplastic processed product as against ASTM 5–6 for the conventional material. This is thought most surprising.

EXAMPLE II

IN-100 powder was also thermoplastically processed and compared with conventional processing. The prealloyed powder, nominally 16% Co, 10% Cr, 3% Mo, 5.2% Al, 4.7% Ti, 0.9% V, 0.05% C, 0.02% B, 0.07% Zr, balance essentially nickel, was passed through a vertical rolling mill (one pass), the rolls being of AISI 52100 steel and 9 inches in diameter, a roll speed of about 10 rpm being used. The powder particles were of a −60 +80 mesh size and were deformed into disc-shaped particles (reduction being about 50%).

Figure 3:
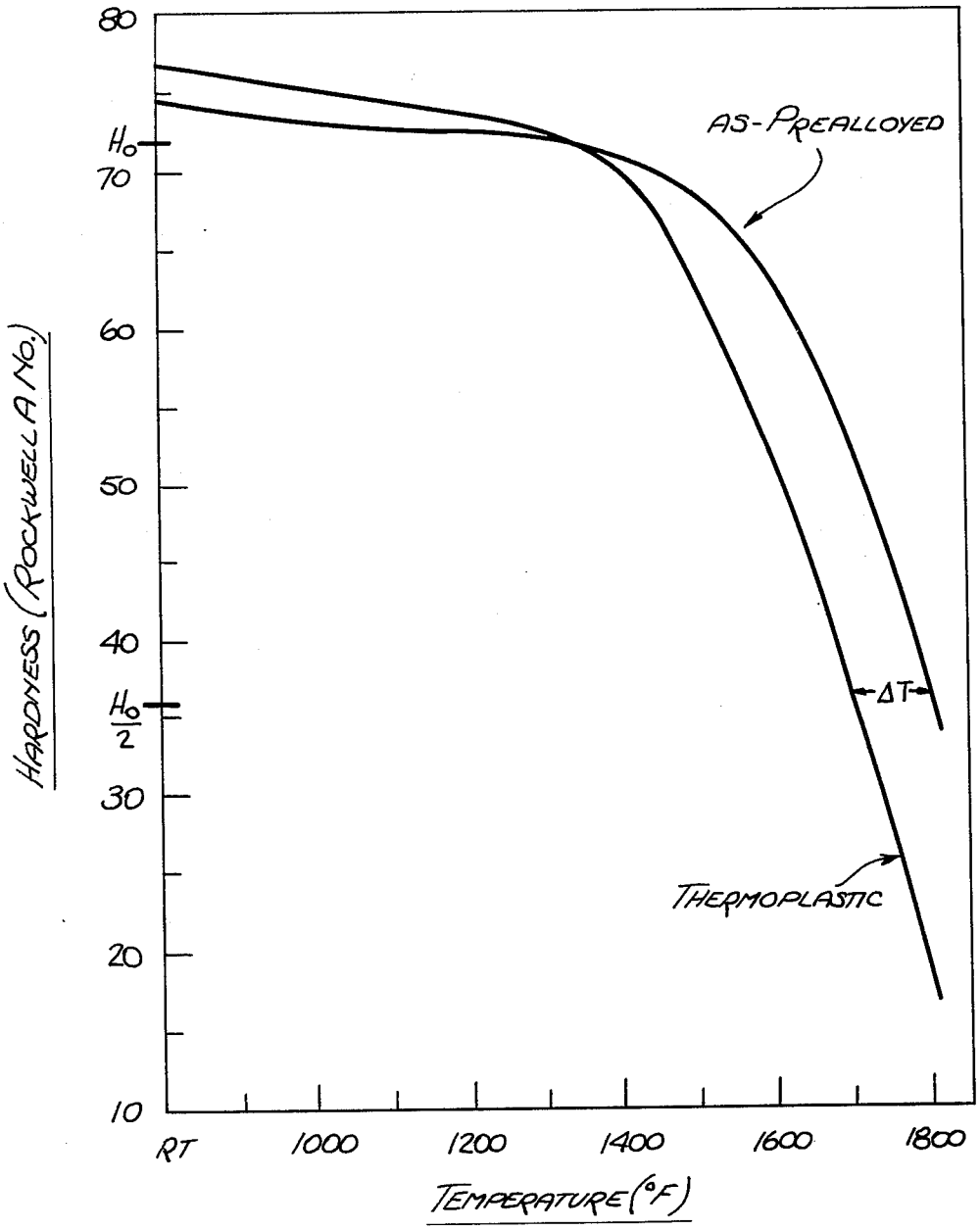

A batch of such processed powder and a batch of as-prealloyed IN-100 powder of the same relative particle size were placed into mild steel cans 2½ inches O.D. × 2¼ inches I.D. The cans were evacuated, heated at 600°F. for about 3 hours and sealed from atmosphere. The cans were than soaked at 1950°F. and compacted against a blank die in a 750 ton extrusion press at the 1950°F. temperature. Hot hardness specimens were machined from these samples as well as tensile specimens. The hot hardness results are graphically depicted in FIG. 3 and it will be observed that the Rockwell A reading for the compacted specimen produced from rolled IN-100 powder was well below that of the conventional material over the important temperature range of 1400° to 1800°F. The ΔT/TM (100%) value for the IN-100 powder processed in accordance herewith was 3.7%.

At a test temperature of 1900°F. (0.01 $min^{-1}$ strain rate), the respective flow stresses were 9,800 psi (as-prealloyed sample) and 5,200 psi (invention).

As indicated above, a most desired coarse grain size is obtained upon solution heat treating, e.g., at 2175°–2250°F. It is considered that this morphology is at least in part attributable to oxides on the prealloyed powder particle surfaces being fractured upon passing through the rolls. Thus, upon consolidation there is less tendency for a continuous network of particles to form which would inhibit grain growth. Upon aging heat treatments stress-rupture properties should be improved.

In addition to the foregoing, the subject invention improves the economics of powder atomization since an extremely broad mesh size range of powder can be treated. Indeed, the coarser prealloyed powders receive the most strain energy (coarser particles need it the most) and this would not be true of all cold working, strain energy inducing techniques. Extremely small powder particle sizes have smaller grain sizes and thus need less strain energy input.

Since low compacting temperatures can be used, materials difficult to hot work and which are also relatively reactive, e.g., titanium-base alloys, can be processed more readily, higher temperatures lending to the reactive problem. Low compacting temperatures improve the economics of the consolidation step (less energy) and also permits the use of alloys which tend to form metal carbides (MC) at prior powder particle boundaries. These alloys, e.g., IN-100, Astroloy, have low refractory contents thus making them less expensive from a raw material viewpoint and also have the advantage of lower density making them attractive on a stength-to-weight basis.

While most prealloyed superalloy starting powders are spherical in shape, the invention is applicable to powders of any shape, the important point being that enough strain energy be imparted to the powder so that upon recrystallization a fine grain size is achieved. While it is appreciated that the powder fed to the rolls will generally have a particle size distribution with some particles passing through the roll gap unworked, the advantages of the invention can be obtained so long as a substantial portion of the powder is cold worked, such as upwards of 20 or 25% by volume, to provide a continuous network of fine grain material following hot consolidation. Usually this is accomplished by deforming the powder upwards of about 20%, e.g., 30 to 50% deformation.

The instant invention, as referred to herein, is particularly applicable to those nickel-base alloys containing (a) 5% or more of aluminum plus titanium, (b) 8% or more of aluminum, titanium, columbium and tantalum, (c) 5% or more of molybdenum plus one-half tungsten at low aluminum and titanium levels and more than about 2% molybdenum plus one-half tungsten at higher aluminum plus titanium levels such as 4% or more, etc.

Given this, superalloys can contain up to 60%, e.g., 1 to 25%, chromium; up to 30%, e.g., 5 to 25%, cobalt, up to 10%, e.g., to 9%, aluminum; up to 8%, e.g., 1 to 7%, titanium, and particularly those alloys containing 4 or 5% or more of aluminum plus titanium; up to 30%, e.g., 1 to 8% molybdenum; up to 25%, e.g., 2 to 20% tungsten; up to 10% columbium; up to 10% tantalum; up to 7% zirconium; up to 0.5% boron; up to 5% hafnium; up to 2% vanadium; up to 6% copper; up to 5% manganese; up to 70% iron; up to 4% silicon, less than about 2%, preferably below about 1%, carbon; and the balance essentially nickel. Cobalt-base alloys of similar composition can be treated. Among the specific superalloys might be listed IN-100, IN-738 and IN-792, Rene alloys 41 and 95, Alloy 718, Waspaloy, Astroloy, Mar-M alloys 200 and 246, Alloy 713, Udimet alloys 500 and 700, A-286, etc. Various of these alloys are more workable than others. Other base alloys such as titanium can be processed as well as refractory alloys such as SU-16, TZM, Zircaloy, etc.

Although the invention has been described in connection with preferred embodiments, modifications may be resorted to without departing from the spirit and scope of the invention, as those skilled in the art will readily understand. Such are considered within the purview and scope of the invention and appended claims.

I claim:

1. A process for improving the consolidation behavior of prealloyed powder particles upon compaction, a substantial portion of the particles processed being of a particle size coarser than +325 mesh and which can range up to at least +20 mesh, which comprises imparting strain energy into such powder by cold reducing a substantial portion of the powder particles by passing them between the rolls of a rolling mill to thus subject them to the compressive forces exerted by the rolls of the mill, whereby substantially discrete powder particles are produced into which strain energy is conferred to render them thermoplastic such that upon heating and compaction a lower flow stress characteristic is obtained than that which obtains in the absence of imparting strain energy.

2. A process as set forth in claim 1 in which the strain energy induced confers a Thermoplastic Physical Characteristic of at least TPC-1 to the prealloyed powder upon compaction.

3. A process as set forth in claim 1 in which the strain energy induced confers a Thermoplastic Physical Characteristic of at least TPC-2 to the prealloyed powder upon compaction.

4. A process as set forth in claim 1 in which the strain energy induced confers a Thermoplastic Physical Characteristic of at least TPC-3 to the prealloyed powder upon compaction.

5. A process as set forth in claim 1 in which the dynamic gap of the rolls is about 0.001 inch to about 0.015 inch.

6. A process as set forth in claim 1 in which the dynamic gap of the rolls is about 0.002 inch.

7. A process as set forth in claim 5 in which the rolls rotate at a speed of up to 1500 rpm.

8. A process as set forth in claim 1 in which the surface of the rolls is of a carbide.

9. A process as set forth in claim 8 in which the carbide roll surface has a polish of less than 100 microinches.

10. A process as set forth in claim 1 in which the rolled powder particles have an aspect ratio of about 1.25 or more.

11. A process as set forth in claim 10 in which the aspect ratio is at least about 2.

12. A process as set forth in claim 1 in which at least about 20% by volume of powder particles are cold worked to provide a continuous network of fine grain material following consolidation.

13. A process as set forth in claim 1 in which a substantial portion of the powder particles undergo a deformation of at least about 20%.

14. A process as set forth in claim 1 in which the prealloyed powder is a nickel-base superalloy containing at least about 5% of titanium plus aluminum.

15. A process as set forth in claim 1 in which the prealloyed powder is a nickel-base superalloy containing a total of 8% or more of titanium, aluminum, tantalum and columbium.

16. A process as set forth in claim 1 in which the prealloyed powder is a nickel-base superalloy having 5% or more of molybdenum plus one-half the tungsten content at low aluminum plus titanium levels and more than about 2% of molybdenum plus one-half the tungsten at higher aluminum plus titanium levels.

17. A process as set forth in claim 1 in which the prealloyed powder to be processed contains up to 60% chromium, up to 30% cobalt, up to 10% of aluminum, up to 8% titanium, up to 30% molybdenum, up to 25% tungsten, up to 10% each of columbium and tantalum, up to 7% zirconium, up to 0.5% boron, up to 5% hafnium, up to 2% vanadium, up to 6% copper, up to 5% manganese, up to 70% iron, up to 4% silicon, less than 2% carbon and the balance essentially nickel.

18. A process as set forth in claim 11 in which the prealloyed powder is selected from the group consisting of IN-100, IN-738, IN-792, Rene alloys 41 and 95, Alloys 713 and 718, Waspaloy, Astroloy, Mar-M alloys 200 and 246, Udimet alloys 500 and 700 and alloy A-286.

19. A process as set forth in claim 1 in which the prealloyed powder is fed to the rolls in substantially monolayer form.

20. A process as set forth in claim 1 in which the prealloyed powder is of an iron-base or cobalt-base alloy.

21. A process as set forth in claim 1 in which the prealloyed powder is a titanium-base alloy.

22. A process as set forth in claim 1 in which the prealloyed powder is a refractory alloy.

23. A process for producing a consolidated metal body from prealloyed powder particles, a substantial portion of the particles processed being of a particle size coarser than +325 mesh and which can range up to at least +20 mesh, which comprises imparting strain energy into such powder by cold reducing at least a portion of prealloyed powder particles by passing them through the rolls of a rolling mill to thus subject them to the compressive forces exerted by the rolls of the mill, consolidating the pre-alloyed powder particles thus treated by first heating the strain energy induced prealloyed particles above their recrystallization temperature, whereupon the particles undergo grain refinement, and then compacting the grain refined powder by subjecting the powder to pressure to form the consolidated body.

24. The process as set forth in claim 23 in which the strain energy induced prealloyed powder particles are heated and subjected to compacting pressure in an isostatic press.

25. The process as set forth in claim 23 in which the consolidated body is thereafter solution treated to grain coarsen the grains of the consolidated body.

* * * * *